United States Patent [19]

Podolsky et al.

[11] Patent Number: 4,471,446

[45] Date of Patent: Sep. 11, 1984

[54] CONTROL SYSTEM AND METHOD FOR A STEAM TURBINE HAVING A STEAM BYPASS ARRANGEMENT

[75] Inventors: Leaman B. Podolsky, Wilmington, Del.; Thomas H. McCloskey, Palo Alto, Calif.; Morton H. Binstock, Pittsburgh, Pa.

[73] Assignee: Westinghouse Electric Corp., Pittsburgh, Pa.

[21] Appl. No.: 397,260

[22] Filed: Jul. 12, 1982

[51] Int. Cl.[3] ..... F01K 13/02

[52] U.S. Cl. ..... 364/494; 60/663; 415/17

[58] Field of Search ..... 364/494, 174, 176, 178, 364/183, 161; 290/40 R; 415/30, 17; 60/663, 646, 662, 660

[56] References Cited

U.S. PATENT DOCUMENTS

| | | | |
|---|---|---|---|
| 3,986,788 | 10/1976 | Rossi | 415/30 X |
| 4,007,595 | 2/1977 | Braytenbah | 364/494 X |
| 4,015,430 | 4/1977 | Braytenbah | 415/17 X |
| 4,056,331 | 11/1977 | Sato | 415/15 |
| 4,090,065 | 5/1978 | Braytenbah et al. | 364/494 |
| 4,091,450 | 5/1978 | Bloch et al. | 364/494 |
| 4,096,699 | 6/1978 | Zitelli | 415/15 X |
| 4,120,159 | 10/1978 | Matsumoto et al. | 415/17 X |
| 4,146,270 | 3/1979 | Nurnberger et al. | 60/664 X |
| 4,166,221 | 8/1979 | McGaha et al. | 290/40 R |
| 4,184,337 | 1/1980 | Bloch | 415/17 X |
| 4,204,258 | 5/1980 | Zitelli et al. | 364/494 |
| 4,205,380 | 5/1980 | Braytenbah | 364/494 |
| 4,274,260 | 6/1981 | Bukajilo | 415/17 X |
| 4,360,882 | 11/1982 | Stewart et al. | 364/494 |
| 4,403,476 | 9/1983 | Johnson et al. | 60/662 X |

*Primary Examiner*—Edward J. Wise
*Attorney, Agent, or Firm*—D. Schron

[57] ABSTRACT

A DEH (digital electrohydraulic) control system for a steam turbine generator having a steam bypass system. The turbine system includes a high pressure turbine having throttle and governor steam admission valves as well as an intermediate pressure turbine having stop and interceptor steam admission valves. The turbine is brought on line by initially controlling steam admission into the intermediate pressure turbine by modulating the interceptor valve in response to a speed error signal generated as a result of the difference between actual and a predetermined reference speed. During this initial control the throttle valve remains in a closed position. When the turbine speed has attained a preset value such as half of synchronous speed, the interceptor valve is held at the same position it was in when the preset speed was attained and the throttle valve is controllably open in response to the same speed error signal. After a preset transfer speed has been attained, control of steam admission to the high pressure turbine is transferred to the governor valve and after synchronous speed has been reached the DEH system switches to a load control mode wherein the signal which controls the positioning of the governor valve is also utilized to control the interceptor valve position. The interceptor valve thereafter will reach a wide open position at a predetermined load.

During the speed control mode of operation the control signal which controls the positioning of the interceptor valve is modified by certain pressure conditions at the input of the interceptor valve after the preset speed is attained.

20 Claims, 6 Drawing Figures

CONTROL SYSTEM AND METHOD FOR A STEAM TURBINE HAVING A STEAM BYPASS ARRANGEMENT

BACKGROUND OF THE INVENTION

1. Field of the Invention:

The invention in general relates to steam turbines having bypass arrangements, and more particularly to a system for speed control of the turbine unit.

2. Description of the Prior Art:

In the operation of a steam turbine power plant, a boiler produces steam which is provided to a high pressure turbine section through a plurality of steam admission valves. Steam exiting the high pressure turbine section is reheated, in a conventional reheater, prior to being supplied, through another valving arrangement, to an intermediate pressure turbine section (if included) and thereafter to a low pressure turbine section, the exhaust from which is conducted into a condenser where the exhaust steam is converted to water and supplied to the boiler to complete the cycle.

The regulation of the steam through the high pressure turbine section is governed by the positioning of the steam admission valves and as the steam expands through the turbine sections, work is extracted and utilized by an electrical generator for producing electricity.

A conventional fossil fueled steam generator, or boiler, cannot be shut down instantaneously. If, while the turbine is operating, a load rejection occurs necessitating a turbine trip (shutdown), steam would normally still be produced by the boiler to an extent where the pressure increase would cause operation of various safety valves. In view of the fact that the steam in the system is processed to maintain a steam purity in the range of parts per billion, the discharging of the process steam can represent a significant economic waste.

Another economic consideration in the operation of a steam turbine system is fuel costs. Due to high fuel costs, some turbine systems are purposely shut down during periods of low electrical demands (for example, overnight) and a problem is encountered upon a hot restart (the following morning) in that the turbine has remained at a relatively hot temperature whereas the steam supplied upon boiler start-up is at a relatively cooler temperature. If this relatively cool steam is admitted to the turbine, the turbine would experience thermal shock which would significantly shorten its useful life. To obviate this thermal shock the steam must be admitted to the turbine very slowly, thereby forcing the turbine to cool down to the steam temperature, after which load may be picked up gradually. This process is not only lengthy, it is also costly.

As a solution to the load rejection and hot restart problems, bypass systems are provided in order to enhance process on-line availability, obtain quick restarts, and minimize turbine thermal cycle expenditures. Very basically, in a bypass operation, the steam admission valves to the turbine may be closed while still allowing steam to be produced by the boiler. A high pressure bypass valve may be opened to divert the steam (or a portion thereof) around the high pressure turbine section, and provide it to the input of the reheater. A low pressure bypass valve allows steam exiting from the reheater to be diverted around the intermediate and low pressure turbine sections and be provided directly to the condenser.

Normally the turbine extracts heat from the steam and converts it to mechanical energy, whereas during a bypass operation, the turbine does not extract the heat from the bypassed steam. Since the elevated temperature of the steam would damage the reheater and condenser, relatively cold water is injected into the high and low pressure bypass steam paths so as to prevent overheating of the reheater and condenser.

Normally in a nonbypass operation, the turbine is accelerated from turning gear to some predetermined speed by slowly opening the steam admission valve to the high pressure turbine, with the valving arrangement to the intermediate pressure turbine being wide open. This type of operation is not suitable with a bypass arrangement since a relatively high pressure is maintained at the output of the reheater and would result in an uncontrolled steam flow through the intermediate pressure turbine tending to the unbalance the high pressure to intermediate pressure load ratio and subjecting the turbine to undesired mechanical and thermal stresses.

SUMMARY OF THE INVENTION

A control arrangement is provided for a steam turbine generator installation which includes a high pressure turbine, a lower pressure turbine, a first steam admission valve means for controllably admitting steam to the high pressure turbine, a second steam admission valve means for controllably admitting steam to the lower pressure turbine and a steam bypass path for bypassing the turbines. Means are provided for generating a speed error signal as a function of the difference between actual and desired turbine speed. The steam is initially prevented from passing into the high pressure turbine and means are provided for initially governing the second valve means so as to admit steam to the lower pressure turbine in response to the speed error signal. After a preset speed has been attained, the second valve means is controlled to maintain a substantially constant positioning of the second valve means while other control means controls the first valve means so as to admit steam to the high pressure turbine in response to the same speed error signal.

The control signal applied to the second valve means is further modified by certain pressure conditions existing at the input to the second valve at the time of, and after preset speed attainment.

BRIEF DESCRIPTION OF THE DRAWINGS

Similar reference characters refer to similar parts throughout the figures.

DESCRIPTION OF THE PREFERRED EMBODIMENT

Figure 1:
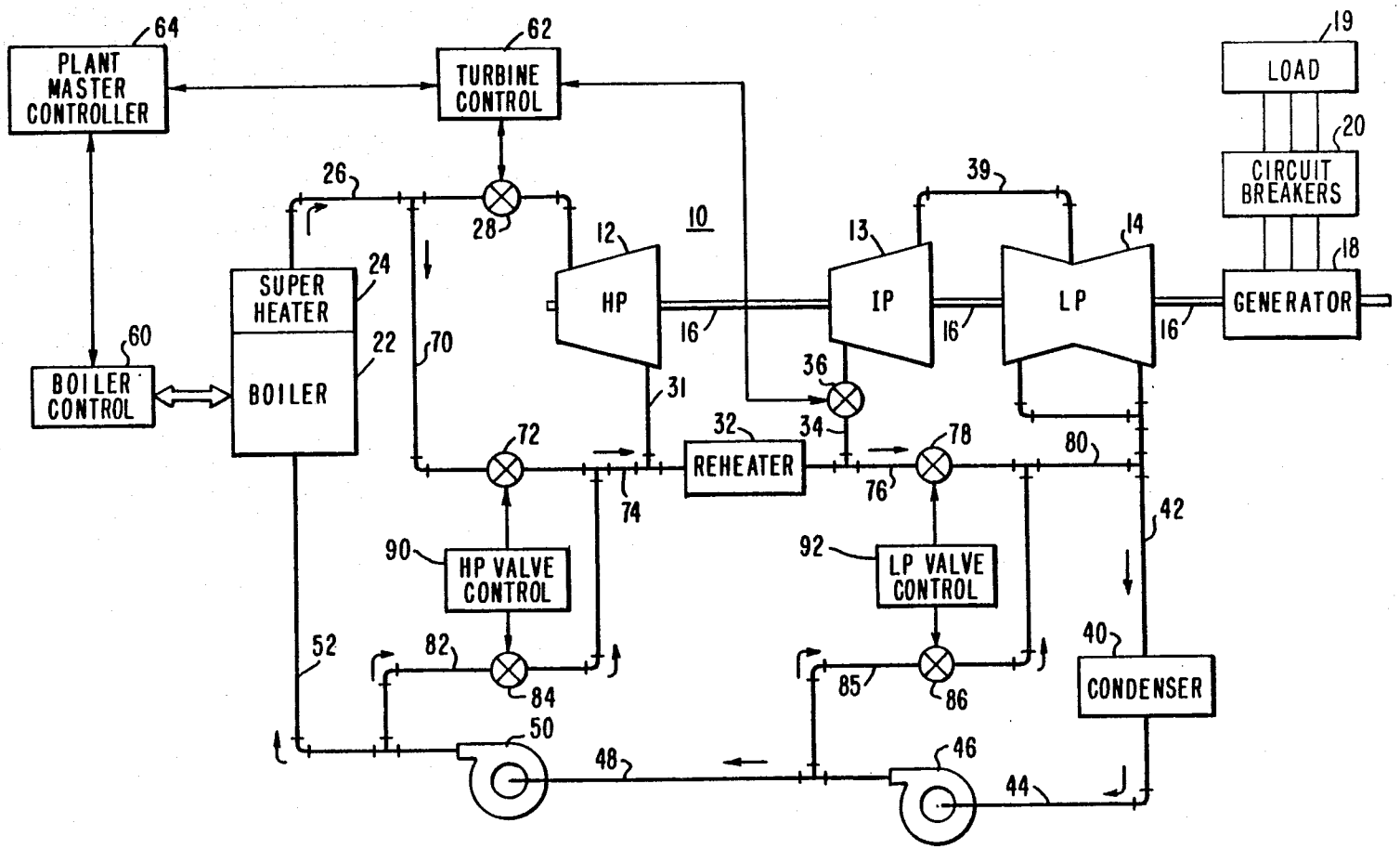
FIG. 1 is a simplified block diagram of a steam turbine generator power plant which includes a bypass system.

FIG. 1 illustrates by way of example a simplified block diagram of a fossil fired single reheat turbine generator unit. In a typical steam turbine generator power plant such as illustrated in FIG. 1, the turbine system 10 includes a plurality of turbine sections in the form of a high pressure (HP) turbine 12, an intermediate pressure (IP) turbine 13 and a low pressure (LP) turbine 14. The turbines are connected to a common shaft 16 to drive an electrical generator 18 which supplies power to a load 19 through main circuit breakers 20.

A steam generating system such as a conventional drum-type boiler 22 operated by fossil fuel, generates steam which is heated to proper operation temperatures by superheater 24 and conducted through a throttle header 26 to the high pressure turbine 12, the flow of steam being governed by a set of steam admission valves 28. Although not illustrated, other arrangements may include other types of boilers, such as super and subcritical oncethrough types, by way of example.

Steam exiting the high pressure turbine 12 via steam line 31 is conducted to a reheater 32 (which generally is in heat transfer relationship with boiler 22) and thereafter provided via steam line 34 to the intermediate pressure turbine 13 under control of valving arrangement 36. Thereafter, steam is conducted, via steam line 39, to the low pressure turbine 14, the exhaust from which is provided to condenser 40 via steam line 42 and converted to water. The water is provided back to the boiler 22 via the path including water line 44, pump 46, water line 48, pump 50, and water line 52. Although not illustrated, water treatment equipment is generally provided in the return line so as to maintain a precise chemical balance and a high degree of purity of the water.

Operation of the boiler 22 normally is governed by a boiler control unit 60 and the turbine valving arrangements 28 and 36 are governed by a turbine control unit 62 with both the boiler and turbine control units 60 and 62 being in communication with a plant master controller 64.

In order to enhance on-line availability, optimize hot restarts, and prolong the life of the boiler, condenser and turbine system, there is provided a turbine bypass arrangement whereby steam from boiler 22 may continually be produced as though it were being used by the turbines, but in actuality bypassing them. The bypass path includes steam line 70, with initiation of high pressure bypass operation being effected by actuation of high pressure bypass valve 72. Steam passed by this valve is conducted via steam line 74 to the input of reheater 32 and flow of the reheated steam in steam line 76 is governed by a low pressure bypass valve 78 which passes the steam to steam line 42 via steam line 80.

In order to compensate for the loss of heat extraction normally provided by the high pressure turbine 12 and to prevent overheating of the reheater 32, relatively cool water in water line 82, provided by pump 50, is provided to steam line 74 under control of high pressure spray valve 84. Other arrangements may include the introduction of the cooling fluid directly into the valve structure itself. In a similar fashion, relatively cool water in water line 85 from pump 46 is utilized, to cool the steam in steam line 80 to compensate for the loss of heat extraction normally provided by the low pressure turbine 14 and to prevent overheating of condenser 40. A low pressure spray valve 86 is provided to control the flow of this spray water, via water line 87, and control means are provided for governing operation of all of the valves of the bypass system. More particularly, a high pressure valve control 90 is provided and includes a first circuit arrangement for governing operation of high pressure bypass valve 72 and a second circuit arrangement for governing operation of high pressure spray valve 84. Similarly, a low pressure valve control 92 is provided for governing operation of low pressure bypass valve 78 and low pressure spray valve 86.

Figure 2:
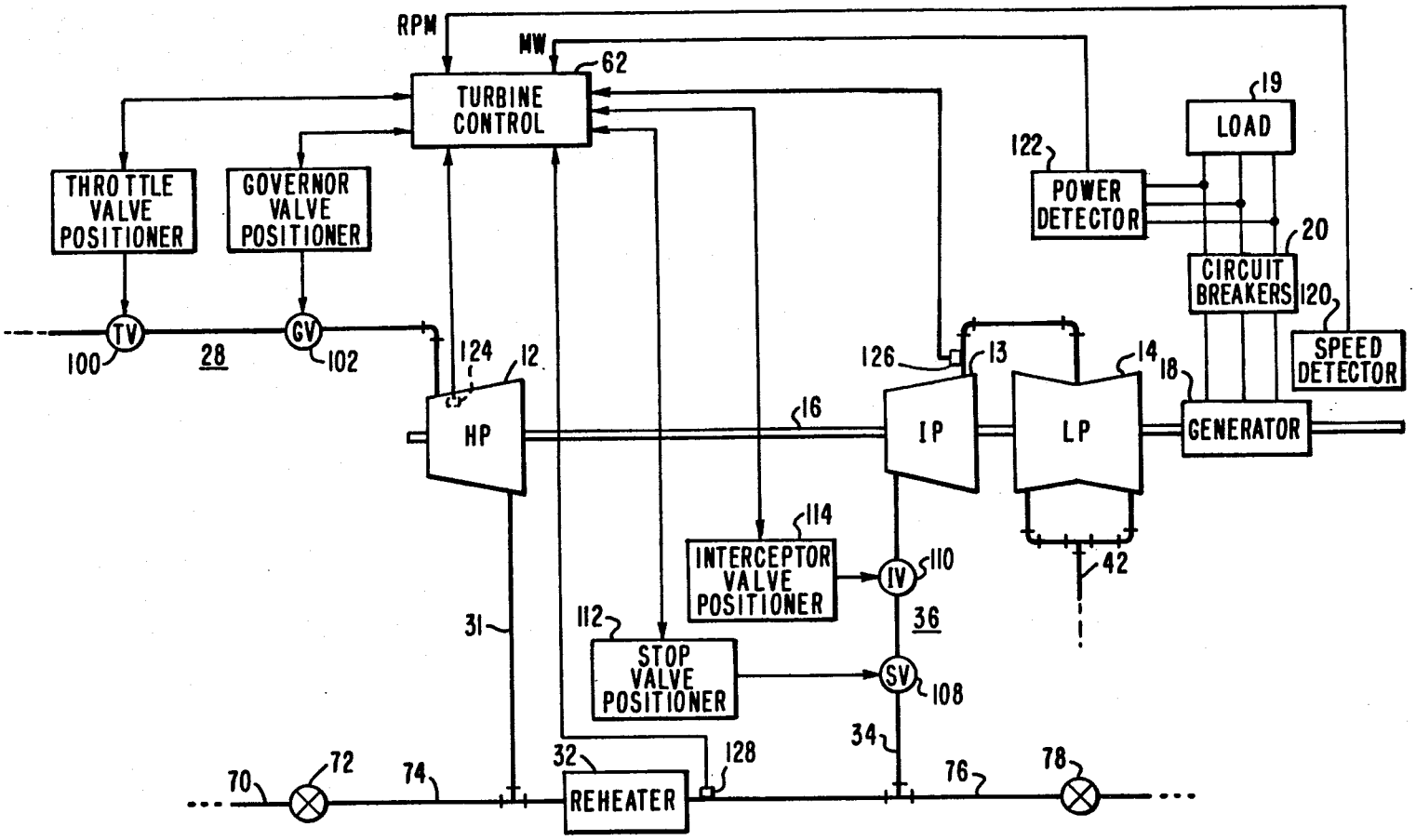
FIG. 2 duplicates a portion of FIG. 1 in somewhat more detail.

FIG. 2 duplicates a portion of FIG. 1 and further details the valving arrangements as well as certain signals utilized in the control system. More particularly the steam admission valves 28 may include at least a throttle valve (TV) 100 and a governor valve (GV) 102 each controlled by a respective positioner 104 and 106. The valving arrangement 36 may include a stop valve (SV) 108 and an interceptor valve (IV) 110 each being controlled by a respective positioner 112 and 114. Although each valve is described in the singular, a plurality of such valves could be provided for the valve function. By way of example a fossil fired large steam turbine may have four throttle valves, eight governor valves, two stop valves and four interceptor valves.

A speed detector 120 is operatively positioned to generate a signal indicative of the rotational speed of the turbine, and the generated signal (RPM) is provided to turbine control unit 64 for control purposes. Another signal provided to turbine control unit 64 is generated by a power detector 122 which, after the circuit breakers 20 are closed, provides a signal (MW) indicative of electrical load.

In carrying out its control operation, turbine control unit 64 is normally responsive to various other parameters in this system amongst which are various pressure indications as indicated by pressure sensors such as 124 providing a pressure indication of steam in the first stage of the high pressure turbine 12, and 126 providing a pressure indication of steam at the intermediate pressure turbine 13 exhaust. In the present arrangement, sensor 128 provides an indication of the hot reheat pressure associated with the output of reheater 32.

Although the present invention is applicable to analog computer controlled turbine systems, it will be described by way of example with respect to a digital computer control system and accordingly the turbine control unit 64 would include, in addition to the digital computer, various analog-to-digital and digital-to-analog conversion circuits. One such type of control system is a DEH (digital electro-hydraulic) turbine control system such as described in the Jan. 1974 issue of the Westinghouse Engineer and as described in numerous U.S. patents a representative number of which include Nos. 4,029,255, 4,090,065, 4,220,869, 4,227,093, 4,246,491, and 4,258,424 all of which are hereby incorporated by reference.

Figure 3:
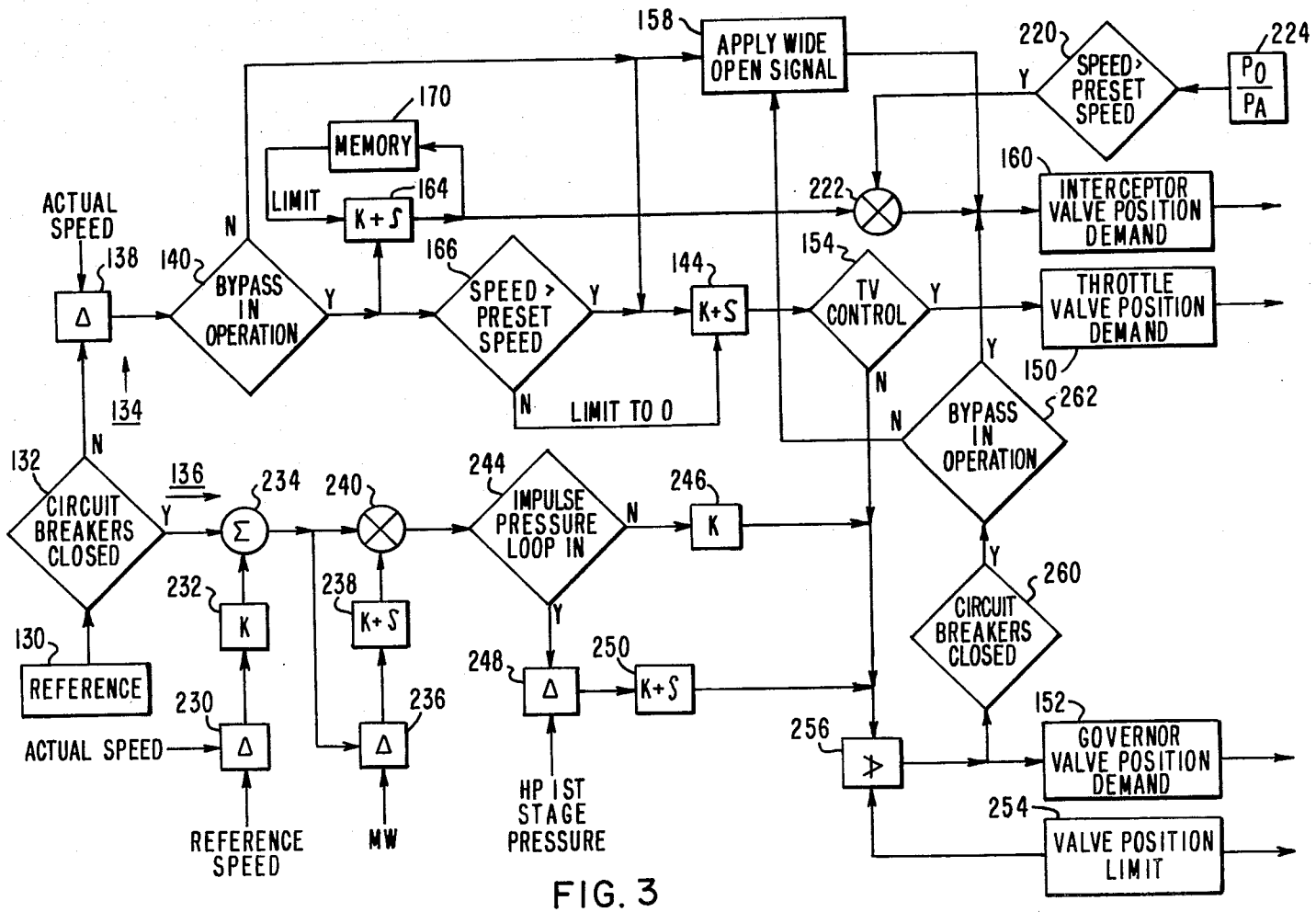
FIG. 3 is a functional control loop diagram in accordance with one embodiment of the invention.

A typical DEH control arrangement is illustrated by the functional control loop diagram of FIG. 3 which additionally includes the modifications in accordance with the present invention.

By way of background information relative to the operation of the steam turbine, when the circuit breakers are open, the torque, as produced by the inlet steam is generally used to accelerate the turbine shaft from turning gear to synchronous speed. As long as the circuit breakers are open the turbine is spinning with no electrical load and it is operative in a speed control mode. Once the shaft frequency is synchronized to the frequency of the load, which may be a power system network, the circuit breakers are closed and power is delivered to the load by the generator. With the circuit breakers closed the net torque exerted on the turbine rotating assemblies of the high pressure, intermediate pressure and low pressure turbines, controls the amount of power supplied to the load, while shaft speed is governed by the frequency of the power system network. Control of steam inlet under these conditions is generally referred to as load control and during which, the turbine speed is monitored for purposes of regulating the power delivered to the load.

Accordingly, and with reference to FIG. 3, a reference is generated as indicated by block 130 with the reference being a desired speed signal if the circuit breakers are open (speed control mode) and being a load reference when the circuit breakers are closed (load control mode). Block 132 is a decision block relative to the closed or opened condition of the circuit breakers. If the circuit breakers are not closed, as indicated by the letter N (no) reference 130 is providing a speed reference which is directed to the path or task 134. If the circuit breakers are closed as indicated by the letter Y (yes) the reference is a load signal which is directed to the path or task 136.

In the speed control mode the speed reference signal is compared with an actual speed signal and the difference is utilized to control the steam admission valves. More particularly, the reference signal and actual speed signal (derived from the RPM signal of FIG. 2) are compared in block 138, the output of which constitutes a speed error signal indicative of the difference between the reference and actual speed signals. During the course of operation if the reference value is greater than the actual speed value the error signal will be of one polarity, for example positive and if the actual speed value is greater than the reference value then the error signal will be of an opposite polarity.

Since the present invention is operative with a bypass system a determination is made as to whether or not the bypass system is in operation, such determination being indicated by block 140. Basically the bypass system may be placed into operation by operator selection (such as by a pushbutton on an operator's panel). When the turbine is not latched, the bypass valves are closed and the stop valve is open. Bypass off can be selected when the turbine is not latched or the interceptor valve is wide open and the bypass valves are closed. If the bypass system is not in operation, the speed error signal is provided to a proportional plus integral (PI) controller 144 which functionally provides an output control signal that is the sum of a first component proportional to the input signal and a second component proportional to the time integral of the input signal, with such function being accomplished in a digital system by means of a well known algorithm.

With the bypass system out of service, operation will be as described in the aforementioned patents with the output of controller 144 being utilized to generate a throttle valve position control signal by throttle valve position demand block 150, when in throttle valve control, and a governor valve position control signal by the governor valve position demand block 152, when in governor valve control. Decision block 154 determines which path the controller output signal will take. In a typical operation, throttle valve control will be utilized below approximately 90% of rated speed. At speeds above this figure, steam flow control is transferred from the throttle valve to the governor valve. With the system not in the bypass mode of operation, block 158 causes the application of a wide open signal to the interceptor valve via the interceptor valve position demand block 160.

Figure 4:
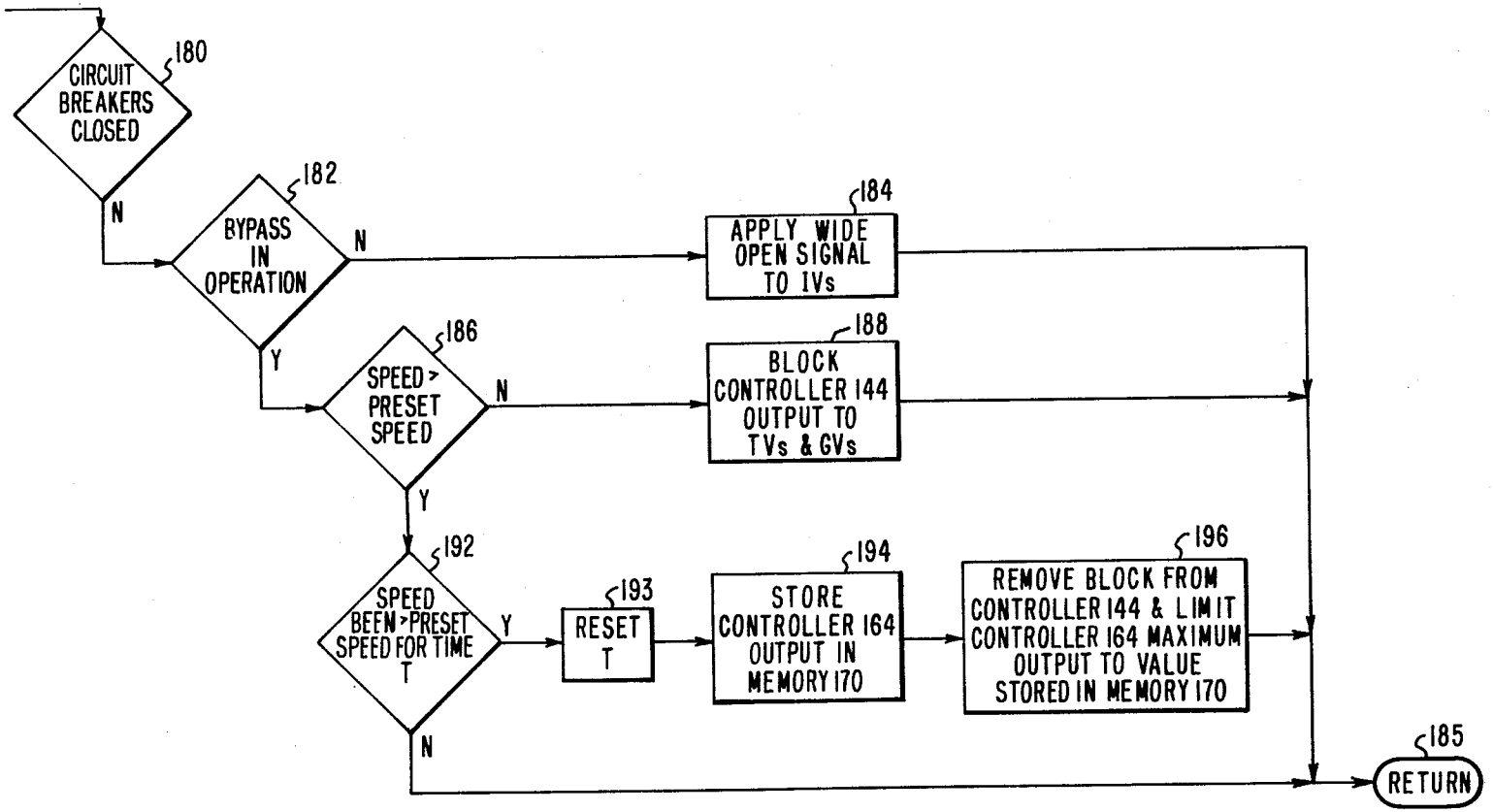
FIG. 4 is a block diagram describing operation of a portion of FIG. 3.

In the present invention, with the bypass system in operation, the interceptor valve is not maintained in a wide open position but is initially closed and thereafter controllably opened by the control signal provided from proportional plus integral controller 164. During this operation the throttle valve which normally would provide steam to the high pressure turbine is maintained in a closed position until such time as a predetermined speed has been attained. By way of example this predetermined speed may be half the rated speed, although for greater flexibility in adjusting the quantity of steam entering the high and intermediate pressure turbines, such as for cooling purposes, this predetermined speed value is adjustable. Accordingly with the bypass in operation, the speed error signal is provided to controller 164 for modulating the interceptor valve but is blocked from throttle valve (and governor valve) controller 144 by virtue of decision block 166 which indicates that the speed error signal will be provided to controller 144 only after the preset speed has been attained and prior to which its output is limited to zero. Upon attainment of the preset speed the throttle valve will be controllably opened from its previously closed condition by means of the control signal provided by controller 144 whereas the interceptor valve is limited to a maximum open position equivalent to its position when the preset speed was attained. This limiting of the interceptor valve position is accomplished by storing the output signal of controller 164 in memory, as indicated by block 170 and thereafter limiting the maximum output signal of controller 164 to the stored value. A control loop for governing these operations is illustrated in FIG. 4, to which reference is now made.

If the circuit breakers are not closed, as determined by decision block 180, then speed control is in effect and the determination must be made, as indicated by decision block 182, as to whether or not the bypass system is in operation. If the bypass is not in operation a wide open signal is applied to the interceptor valve, as indicated by block 184 and a return to start is indicated by block 185.

If the bypass system is in operation then a determination must be made as to whether or not the turbine speed has attained the preset speed, this decision being indicated by block 186. If the turbine speed is less than the preset speed, controller 144 is prevented from providing an output signal to govern the throttle and governor valves, as indicated by block 188. If, on the other hand, the preset speed has been attained the throttle valve will be opened, but only after a certain time period T of sufficient time duration to eliminate the effects of overshoot and valve inertia. Accordingly, decision block 192 is provided to make the determination of whether or not the predetermined time period T has elapsed. If it has, the timing function is reset as indicated by block 193 and the value of the output signal of controller 164 is stored into memory 170, as indicated by block 194. As indicated by block 196, controller 144 is now allowed to provide a controlling output signal and the maximum output of controller 164 is limited to that value which has been stored in memory 170.

Referring once again to FIGS. 2 and 3, and by way of summary, the turbine is started off of turning gear, and with the bypass system in operation, steam is introduced into the intermediate pressure turbine 13 under control of the interceptor valve 110. Initially the throttle valve 100 is closed whereas the governor valve 102 and stop valve 108 are both wide open. The modulation of the interceptor valve 100 is performed in accordance with the value of the output signal of controller 164 such signal being generated as a result of a speed error signal. After the preset speed has been attained, and if the actual speed is less than the reference speed thus generating a positive speed error signal, steam will be admitted to the high pressure turbine 12 under control of throttle valve 100 as governed by the output signal of controller 144, likewise generated as a result of the speed error signal.

Due to the limit on the output of controller 164, interceptor valve 110 will remain in the same position it was in even in the presence of an increasing speed error signal. If the speed condition changes such that the actual speed becomes greater than the reference, then the output signal of controller 164 will decrease below the limit value so as to tend to close the interceptor valve. When the actual speed thereafter becomes less than the reference speed, the output of controller 164 will again be restored to, and limited by, the previously stored value in memory 170.

Figure 5A:
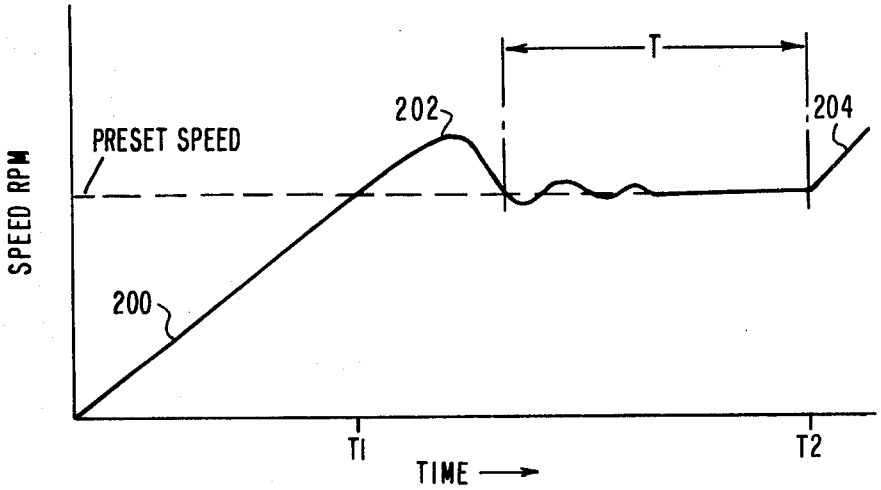
FIGS. 5A and 5B are curves to aid in an understanding of the operation of the present invention.
Figure 5B:
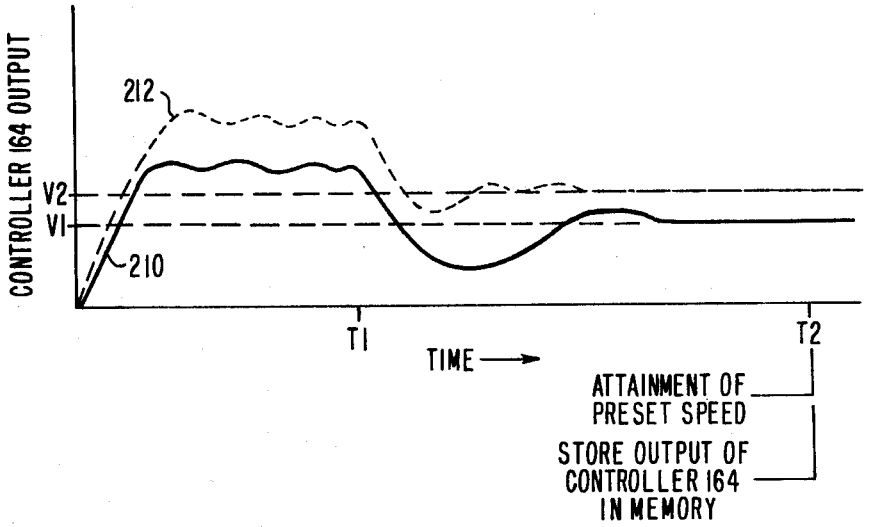

A portion of the operation just described is graphically depicted in FIGS. 5A and 5B. In FIG. 5A time is plotted on the horizontal axis and shaft rotational speed is plotted on the vertical axis. With the steam being admitted to the intermediate pressure turbine through the interceptor valve, rotational speed increases as indicated by the initial portion of curve 200. At time T1 the preset speed is reached, however due to inertia effects there is some overshoot as indicated by portion 202. After some subsequent oscillation about the preset speed the effects of inertia are eliminated or minimized such that at time T2, representing the attainment of the preset speed after the predetermined time period T, throttle valve control can be initiated and speed thereafter increased up to the speed at which transfer is made from throttle valve to governor valve control, at a rate as indicated by the curve portion 204.

In FIG. 5B time is plotted on the same time scale as that in FIG. 5A and the output of controller 164 is plotted on the vertical axis. Solid curve 210 represents the controller 164 output with the output pressure of reheater 32 (FIG. 2) being at a certain value, for example at 100% of its rated value. The output of controller 164 once the preset speed has been attained is indicated by level V1. Initially, when accelerating, the turbine needs more steam than when in a steady state condition and accordingly the controller output overshoots the steady state level V1 and thereafter starts to decrease at time T1 when the preset speed has been reached. After the predetermined time period T and a definite attainment of the preset speed, the output of controller 164 is limited to a maximum output of V1. (As previously indicated the output may dip below the V1 level should speed conditions necessitate it).

The hot reheat pressure is the pressure at the input of the intermediate turbine valving and if the hot reheat pressure increases while the interceptor valve remains in a fixed position, the flow therethrough would increase and would tend to speed up the intermediate pressure turbine. It is preferable that a speed increase be performed by admission of steam to the high pressure turbine since too small a steam flow going through the high pressure turbine would tend to overheat it. Dotted curve 202 of FIG. 5B illustrates a controller 164 output signal for a hot reheat pressure at, for example, 50% of rated value and it is seen that the steady state output value is at a higher level V2.

In order to compensate for varying hot reheat pressures, the arrangement of FIG. 3 varies the value of the output signal of controller 164 provided to interceptor valve position demand 160. After the preset speed has been attained, as indicated by decision block 220 in FIG. 3, the output of controller 164 is modified in multiplication block 222 by a factor $P_0/P_A$ as indicated by block 224, where $P_A$ is the actual hot reheat pressure and $P_O$ the hot reheat pressure at the time the preset speed was attained.

After approximately 90% of synchronous speed has been attained, transfer from throttle valve to governor valve control may be initiated with the interceptor valve being maintained in its position as determined by the limited output of controller 164. After synchronous speed has been attained the circuit breakers may be closed and operation will be in the load control mode, in which case reference 130 of FIG. 3 provides a load reference and task 136 is placed into operation.

Basically, the reference is modified by frequency error so as to obtain a speed compensated load reference signal. This is accomplished by comparing the actual speed with a reference speed in comparison block 230 and generating a signal proportional to the difference, by block 232, and summing the resultant signal with the load reference in summation block 234.

A megawatt feedback loop may selectively be placed in operation to generate a speed compensated and megawatt trimmed reference signal. To accomplish this, the modified reference from summation block 234 is compared with the generator megawatt output in comparison block 236 with the difference being applied to a proportional plus integral controller 238, the output of which is multiplied with the modified signal, as indicated by multiplication block 240.

An impulse pressure feedback loop may be selectively inserted, as indicated by decision block 244 and if the loop is out of service the reference signal from multiplier block 240 is provided to a proportional controller 246. If the feedback loop is in service the signal from multiplier block 240 serves as a pressure set point reference which is compared with the turbine's first stage stream pressure in comparison block 248. The resulting pressure error is applied to proportional plus integral controller 250, the output signal of which initiates changes in governor valve position so long as the controller's output signal does not exceed a governor valve position limit set point as indicated by valve position limit block 254 and limit block 256. Such control is standard in the DEH control system however in the present invention the output signal from limiter 256 is additionally provided so as to govern the modulation of the interceptor valve.

During bypass operations, the impulse pressure loop (as well as the megawatt feedback loop) will be out of service and accordingly proportional controller 246 will be providing the control signal. This signal in addition to being applied to the governor valve position demand block 152 is also supplied to the interceptor valve position demand block 160 if the circuit breakers are closed as indicated by decision block 260, and if the bypass is in operation as indicated by decision block 262. If the bypass system is not in operation then the output signal of limiter 256 will be directed to the path which applies a wide open signal to the interceptor valve.

Assuming that the bypass is in operation, both the governor and interceptor valves will be stepped open by some predetermined amount in order to pick up an initial percentage of load, for example 5%. Thereafter as the load reference increases both the governor and interceptor valves will be ramped to a wide open position with the interceptor valve reaching its wide open position at some predetermined load such as 25%–35%, by way of example.

What we claim is:

1. A control system for a steam turbinegenerator installation having a high pressure turbine, a lower pressure turbine, first valve means for controllably admitting steam to said high pressure turbine, second valve means for controllably admitting steam to said lower pressure turbine and a steam bypass arrangement for by-passing said turbines, comprising:

(A) means for generating a speed error signal as a function of the difference between actual and desired turbine speed;

(B) means for initially governing said second valve means, when in bypass operation, so as to modulate the admission of steam to said lower pressure turbine in response to said speed error signal; and (C) means for thereafter simultaneously governing said first valve means so as to admit steam to said high pressure turbine in response to said same speed error signal, when said turbine has attained a predetermined preset speed.

2. A control system for a steam turbinegenerator installation having a high pressure turbine, a lower pressure turbine, first valve means for controllably admitting steam to said high pressure turbine, second valve means for controllably admitting steam to said lower pressure turbine and a steam bypass arrangement for bypassing said turbines, comprising:

(A) means for generating a speed error signal as a function of the difference between actual and desired turbine speed;

(B) means defining a first controller for providing an output signal in response to said speed error signal;

(C) means defining a second controller for providing an output signal in response to said speed error signal when said turbine has attained a predetermined preset speed;

(D) means responsive to said output signal of said first controller for initially governing said second valve means, when in bypass operation, to admit steam to said lower pressure turbine, (E) means for limiting the value of said output signal of said first controller upon attainment of said preset speed; and (F) means responsive to said output signal of said second controller, when provided upon attainment of said preset speed, to govern said first valve means to admit steam to said high pressure turbine.

3. Apparatus according to claim 2 wherein said means for limiting includes:

(A) memory means;

(B) means for storing the value of said output signal of said first controller in said memory means upon attainment of said preset speed; and (C) means for limiting the maximum value of said output signal of said first controller to said stored value.

4. Apparatus according to claim 2 wherein (A) said controllers are proportional plus integral controllers.

5. Apparatus according to claim 2 which includes:

(A) means for obtaining an indication of the pressure at the input of said second valve means;

(B) means for storing said pressure indication upon attainment of said preset speed;

(C) means for modifying said output signal of said first controller, after attainment of said preset speed by a factor related to said pressure indication.

6. Apparatus according to claim 5 wherein:

(A) said modifying factor is $P_O/P_A$, where $P_A$ is the actual pressure and $P_O$ is said stored pressure indication.

7. A control system for a steam turbine-generator installation having a high pressure turbine and a lower pressure turbine, comprising:

(A) throttle and governor valve means for admitting steam to said high pressure turbine;

(B) at least interceptor valve means for admitting steam to said lower pressure turbine;

(C) bypass means operable, when activated, to bypass steam around said high pressure and lower pressure turbines;

(D) means for opening said interceptor valve means to a wide open condition during turbine start-up, when said bypass means is not activated;

(E) means for generating a desired speed reference signal;

(F) means for generating an actual speed signal indicative of actual turbine speed;

(G) means responsive to said desired and actual speed signals for providing a speed error signal indicative of the difference between them; and (H) means for initially controlling said interceptor valve means, when said bypass means is activated, to modulate the introduction of steam into said lower pressure turbine, in response to said speed error signal and thereafter, when a first predetermined preset speed is attained, additionally controlling said throttle valve means to modulate the introduction of steam into said high pressure turbine.

8. Apparatus according to claim 7 wherein said last-named means includes:

(A) a first controller operable to provide an output control signal having a maximum value equivalent to the value of control signal when said first preset speed is attained; and (B) a second controller operable to provide an output signal only after attainment of said first preset speed.

9. Apparatus according to claim 8 which includes:

(A) means for varying said output control signal of said first controller in accordance with pressure conditions at the steam inlet to said interceptor valve means.

10. Apparatus according to claim 9 wherein said means for varying includes:

(A) means for obtaining an indication $P_O$ of said pressure when said first preset speed is attained;

(B) means for obtaining an ongoing indication of actual pressure $P_A$; and (C) means for modifying said output control signal of said first controller by a factor $P_O/P_A$.

11. Apparatus according to claim 7 which includes:

(A) means for opening said throttle valve means during a time period after a second predetermined preset speed has been attained and for thereafter controlling said governor valve means to modulate the introduction of steam into said high pressure turbine.

12. Apparatus according to claim 11 wherein:

(A) said means controlling said governor valve means includes said second controller.

13. In an electric power plant having a steam turbine driving an electric generator for delivery of power to a load wherein said steam turbine includes a high pressure turbine and at least a lower pressure turbine, the improvement comprising:

(A) a control unit for operating the steam turbinegenerator in a speed control mode prior to delivery of power to the load and for operating the steam turbinegenerator in a load control mode upon delivery of power to the load;

(B) bypass means operable, when activated, to bypass steam around said high pressure and lower pressure turbines;

(C) first valve means for admitting steam to said high pressure turbine;

(D) second valve means for admitting steam to said lower pressure turbine;

(E) said control unit being operable to generate a desired speed reference signal when in speed control and a desired load reference signal when in load control;

(F) means for obtaining an indication of actual turbine speed;

(G) said control unit being operable, when said bypass means is activated and when in speed control to generate a first control signal in response to the difference between actual and desired turbine speed for controlling said second valve means to introduce steam initially into said lower pressure turbine; and (H) said control unit being thereafter operable in response to said difference between actual and desired turbine speed to generate a second control signal, upon the attainment of a first predetermined preset speed, for controlling said first valve means to introduce steam into said high pressure turbine.

14. Apparatus according to claim 13 which includes:

(A) means for limiting the maximum value of said first control signal when said preset speed is attained.

15. Apparatus according to claim 13 wherein:

(A) said first valve means includes throttle valve means and governor valve means in series therewith; and wherein (B) said control unit is operable to fully open said throttle valve means and provide said second control signal to control said governor valve means, after attainment of a second predetermined preset speed.

16. Apparatus according to claim 13 which includes:

(A) means for obtaining and storing indications of pressure at the inlet of said second valve means; and (B) means for modifying said first control signal by a factor $P_O/P_A$ where $P_0$ is said pressure at the attainment of said preset speed and $P_A$ is the current value of said pressure.

17. Apparatus according to claim 13 which includes:

(A) means for obtaining an indication of actual load, when in said load control mode; and wherein (B) said control unit is operable to provide an additional control signal in response to the difference between actual and desired load for controlling said first valve means as well as said second valve means.

18. A method of controlling a steam turbinegenerator installation having a high pressure turbine, a lower pressure turbine, a first valve means for controllably admitting steam to said high pressure turbine, a second valve means for controllably admitting steam to said lower pressure turbine, and a steam bypass arrangement for bypassing said turbines, comprising the steps of:

(A) deriving a control signal in response to the difference between a desired and actual turbine speed;

(B) utilizing said control signal to govern said second valve means;

(C) deriving another control signal in response to the difference between a desired and actual turbine speed;

(D) utilizing said another control signal to govern said first valve means, when said turbine has attained a predetermined preset speed.

19. A method according to claim 18 which includes the step of:

(A) limiting the maximum value of said first-named control signal, upon attainment of said preset speed.

20. A method according to claim 18 which includes the step of:

(A) varying said first-named control signal as a function of pressure conditions at the inlet of said second valve means.

* * * * *